US012692108B2

(12) United States Patent
Brown et al.

(10) Patent No.: US 12,692,108 B2
(45) Date of Patent: Jul. 28, 2026

(54) ASSEMBLY FOR RESTRAINING MEDIA IN AN AUTOMATIC DOCUMENT FEEDER

(71) Applicant: Lexmark International, Inc., Lexington, KY (US)

(72) Inventors: Timothy Marc Brown, Lexington, KY (US); Ronaldo Maningas Calapis, Calamba City (PH); Robert McAlister Whitesell, Georgetown, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 478 days.

(21) Appl. No.: 18/196,009

(22) Filed: May 11, 2023

(65) Prior Publication Data

US 2024/0375896 A1 Nov. 14, 2024

(51) Int. Cl.
*B65H 3/06* (2006.01)
*B65H 3/56* (2006.01)

(52) U.S. Cl.
CPC ..... *B65H 3/56* (2013.01); *B65H 3/0684* (2013.01); *B65H 2402/20* (2013.01); *B65H 2402/54* (2013.01); *B65H 2404/1521* (2013.01); *B65H 2701/1311* (2013.01); *B65H 2801/06* (2013.01)

(58) Field of Classification Search
CPC ..... B65H 3/0684; B65H 2402/54
See application file for complete search history.

(56) References Cited

U.S. PATENT DOCUMENTS 7,584,953 B2 * 9/2009 Johnson ..... G03G 15/6511 271/118
2020/0165086 A1 * 5/2020 Zaitsu ..... B65H 5/26
2022/0127089 A1 * 4/2022 Tateishi ..... B65H 3/0607
2024/0383706 A1 * 11/2024 Lee ..... B65H 3/0684

* cited by examiner

*Primary Examiner* — Howard J Sanders

(57) ABSTRACT

An assembly for restraining media in an input tray includes a pick mechanism having a pick arm mounted at a first end thereof on a shaft. A media stop is positioned to be engageable by a leading edge of the media when the media is disposed in the input tray. The media stop is held by the pick arm in a media stop position for restraining the media in a media loading position when the pick arm is in a raised position and is released by the pick arm from being held in the media stop position when the pick arm is in a lowered position. A spring mounted above the pick mechanism imparts a downward force at the first end of the pick arm for holding the pick arm in the raised position in order to hold the media stop member in the media stop position.

13 Claims, 6 Drawing Sheets

ASSEMBLY FOR RESTRAINING MEDIA IN AN AUTOMATIC DOCUMENT FEEDER

CROSS REFERENCES TO RELATED APPLICATIONS

None.

BACKGROUND

1. Field of the Disclosure

The present disclosure relates generally to imaging devices, and more particularly to an assembly for varying pick normal force and restraining media in an automatic document feeder of an imaging device.

2. Description of the Related Art

Scanning is a standard imaging device feature that converts a document into digital form. Typically, scanning is utilized when performing functions that require capturing of images on media sheets. Such functions may include faxing, copying, and storing electronic copies on a computer. Some imaging devices may incorporate a flatbed scanner and/or an automatic document feeder (ADF) to feed multiple documents automatically and sequentially to a scan module. The ADF typically includes an input tray which holds a stack of media to be scanned and a pick mechanism which picks a single sheet of media from the stack of media on the input tray and feeds the picked media into the media path. Each single sheet of picked media passes the scan module where image data of the media is captured and is fed out into an output tray where users can retrieve the scanned documents.

There are many types of media picking mechanisms, most of which rely upon certain assumptions regarding the general characteristics of friction between the mechanical components of the pick mechanism and the media sheet. If the design assumptions are met, then only a single topmost media is separated from the media stack and fed into the scanner. However, if these assumptions are not satisfied, certain pick and feed errors can result. Common pick and feed problems include (1) fail to pick errors where pick tires slip on the media sheet and the media sheet either fails to move or does not move far enough to be fed into the media path, and (2) multi-feeding errors where more than one media sheet is fed because subsequent media sheets stick together.

Pick mechanisms can be designed to minimize the frequency at which the above-mentioned errors occur under nominal operating conditions, but the mechanisms can still be susceptible to these types of errors due to a large range of variables. Variables such as media type, media weight, media texture, media condition (e.g., punched, folded, or deformed), environmental conditions, wear of the mechanism and other unexpected variations can affect the consistency and reliability of the pick mechanism. In addition, customer loading conditions, such as when originals are improperly located in the input tray, may also affect the consistency, timing and reliability of the pick mechanism. Media jams may occur because of picking and feeding errors in the ADF which can cause damage to original copies being scanned. Some common designs work around increasing pick normal force, such as by adjusting clutch torque resistance or adding more weight in the pick mechanism. Other designs utilize complex mechanisms that provide media stops to aid users in properly positioning the media stack in the input tray at the outset of performing a scan operation. While there are many design approaches used to address these problems, it would be cost prohibitive to design a complex mechanism that could handle every combination of such a wide range of variables. A more cost-effective and simple design is needed.

SUMMARY

Embodiments of the present disclosure provides features that deter errant loading of media in an automatic document feeder. In one embodiment, an assembly for restraining media in an input tray of an imaging device is disclosed. The assembly includes a pick mechanism having a pick arm mounted at a first end thereof on a shaft and a pick roller mounted at a second end of the pick arm. The pick arm is movable between a lowered position in which the pick roller is lowered towards the input tray and a raised position in which the pick roller is lifted away from the input tray. A media stop member is positioned to be engageable by a leading edge of the media when the media is disposed in the input tray. The media stop member is held by the pick arm in a media stop position for restraining the media in a media loading position when the pick arm is in the raised position and is released by the pick arm from being held in the media stop position when the pick arm is in the lowered position. A spring is mounted above the pick mechanism to impart a downward force at the first end of the pick arm for holding the pick arm in the raised position in order to hold the media stop member in the media stop position.

In another embodiment, the spring imparts to the pick arm a first rotational force that urges the pick arm to rotate in a first direction that is towards the lowered position when the pick arm is in the lowered position and a second rotational force that urges the pick arm to rotate in a second direction that is towards the raised position when the pick arm is in the raised position in order to hold the pick arm in the raised position thereby holding the media stop member in the media stop position.

In another embodiment, the spring is in contact with the pick arm when the pick arm moves between the lowered position and the raised position. When the pick arm is disengaged from the raised position the spring imparts a first rotational force that urges the pick arm towards the lowered position. When the pick arm engages the raised position the spring imparts a second rotational force opposite the first rotational force to hold the pick arm in the raised position thereby holding the media stop member in the media stop position.

In some embodiments, the spring includes a first segment attached to a frame of the imaging device and a second segment extending at an angle from the first segment. The first segment of the spring contacts the pick arm when the pick arm is in the raised position and the second segment of the spring contacts the pick arm when the pick arm is in the lowered position. In other embodiments, the pick arm includes a rib projecting from the first end thereof towards the spring such that the spring engages the rib to impart the downward force to the pick arm.

BRIEF DESCRIPTION OF THE DRAWINGS

The accompanying drawings incorporated in and forming a part of the specification, illustrate several aspects of the present disclosure, and together with the description explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
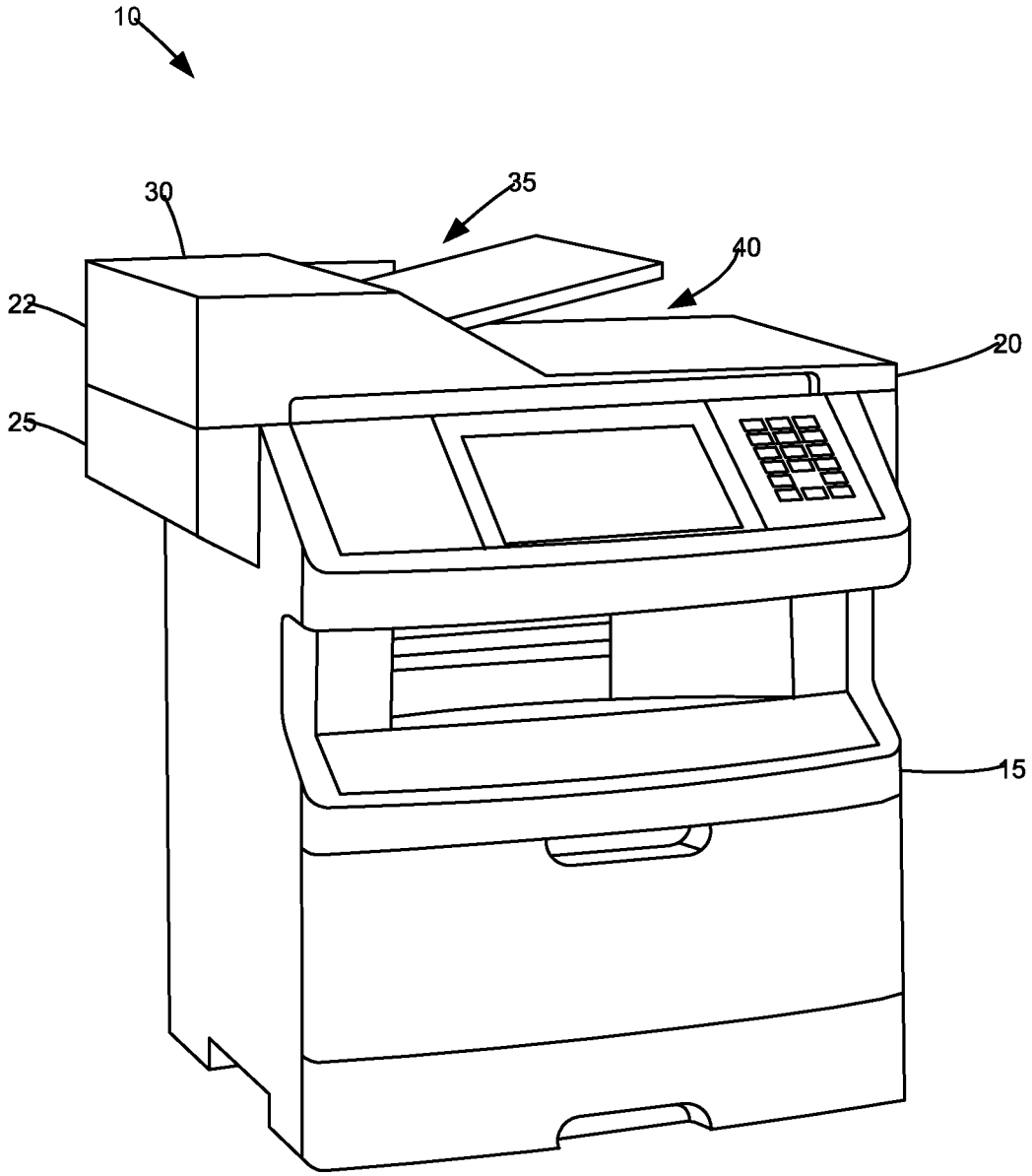
FIG. 1 illustrates an imaging device according to one example embodiment.

FIG. 1 shows an example embodiment of an imaging device 10 having a lower portion comprising a printer 15 and an upper portion comprising a scanner 20. Scanner 20 has a scan window cover 22 for covering a scan window of a flatbed scanner portion 25 Additionally, in the example shown, scan window cover 22 includes an automatic document feeder (ADF) 30 to allow automatic feeding of documents. For manual scanning, scan window cover 22 is lifted or pivotably rotated along one edge away from the scan window so that a user can place an original on the scan window. When using ADF 30 for automatic feed mode, scan window cover 22 is held in its closed position relative to the scan window. One or more originals placed on a media input area 35 are then moved through an image capture region within ADF 30 and, thereafter, to a media output area 40. ADF 30 may include a scan module (not shown) housed internal to ADF 30 for scanning sheets of media. Alternatively, ADF 30 may utilize the scan module of the flatbed scanner for scanning.

Figure 2A:
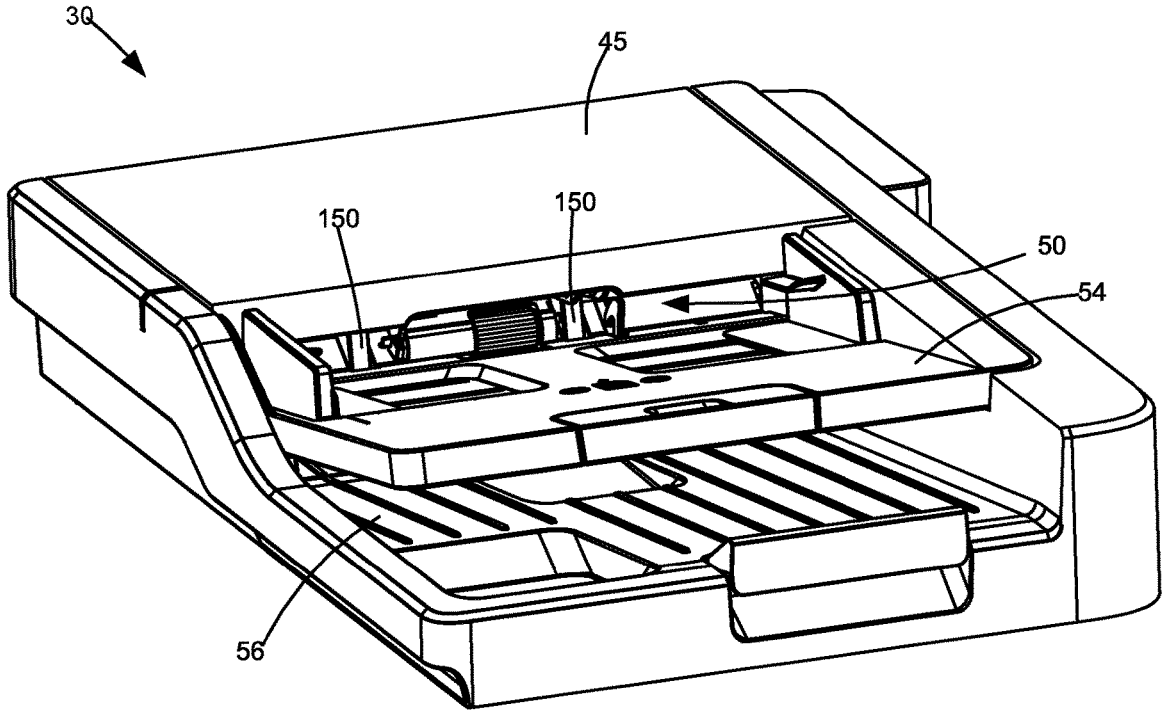
FIGS. 2A and 2B are perspective views of an automatic document feeder (ADF) including a pick mechanism and with a top cover of the ADF in a closed position and a partially opened position, respectively, according to one example embodiment.
Figure 2B:
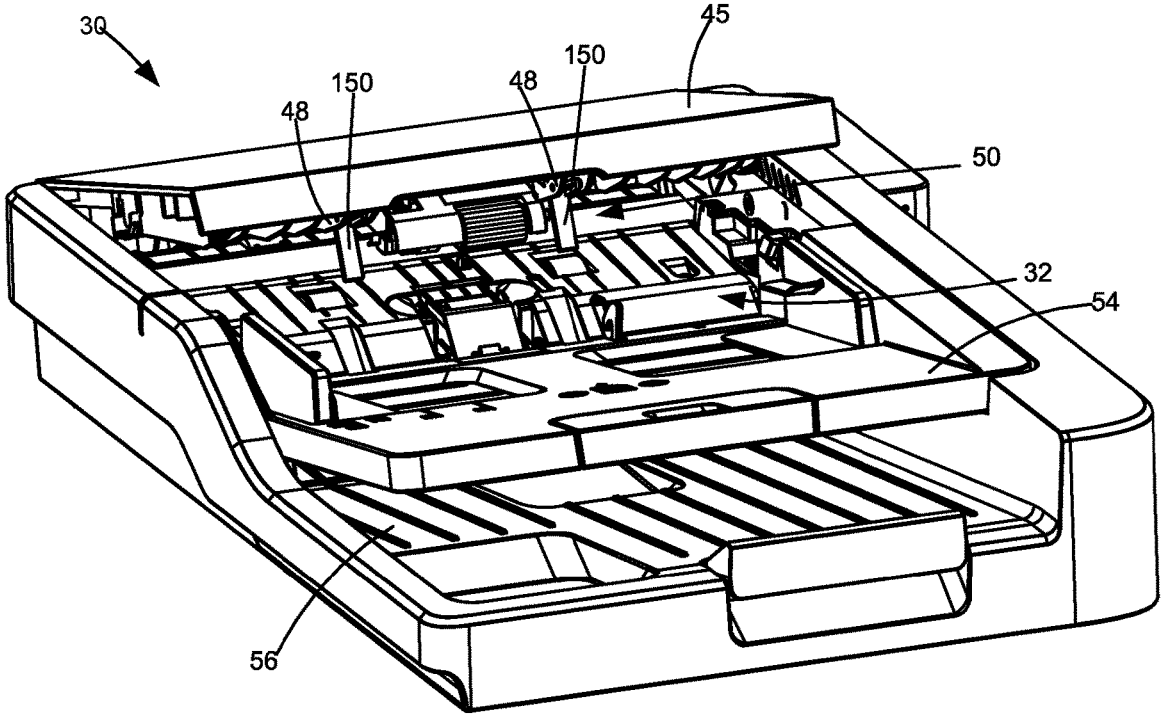

FIGS. 2A and 2B are perspective views of an example embodiment of ADF 30 of scanner 20. FIG. 2A shows a top cover 45 of ADF 30 in a closed position while FIG. 2B shows top cover 45 in a partially opened position exposing a pick mechanism 50. An input tray 54 provides the media input area where originals to be scanned are placed and an output media support 56 provides the media output area where the scanned originals are disposed. An ADF media path 32 extends within ADF 30 between input tray 54 and output media support 56. A plurality of feed rolls (not shown) are disposed along ADF media path 32 for conveying media sheets from input tray 54 to the scan module, and then to output media support 56.

Figure 3:
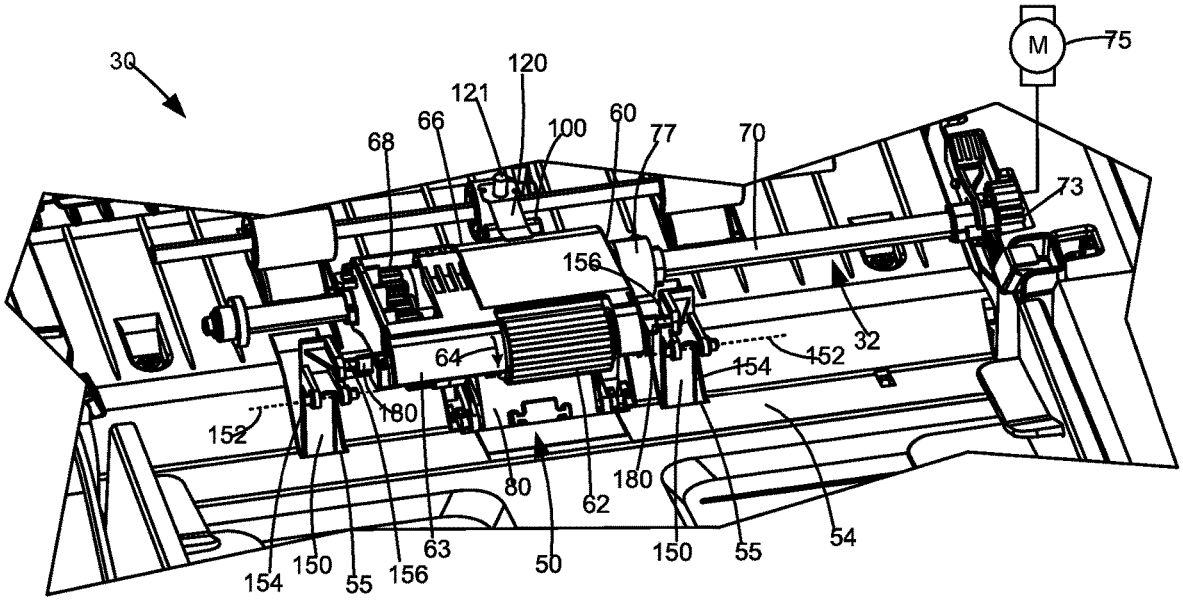
FIG. 3 is a perspective view of the pick mechanism according to one example embodiment.
Figure 4A:
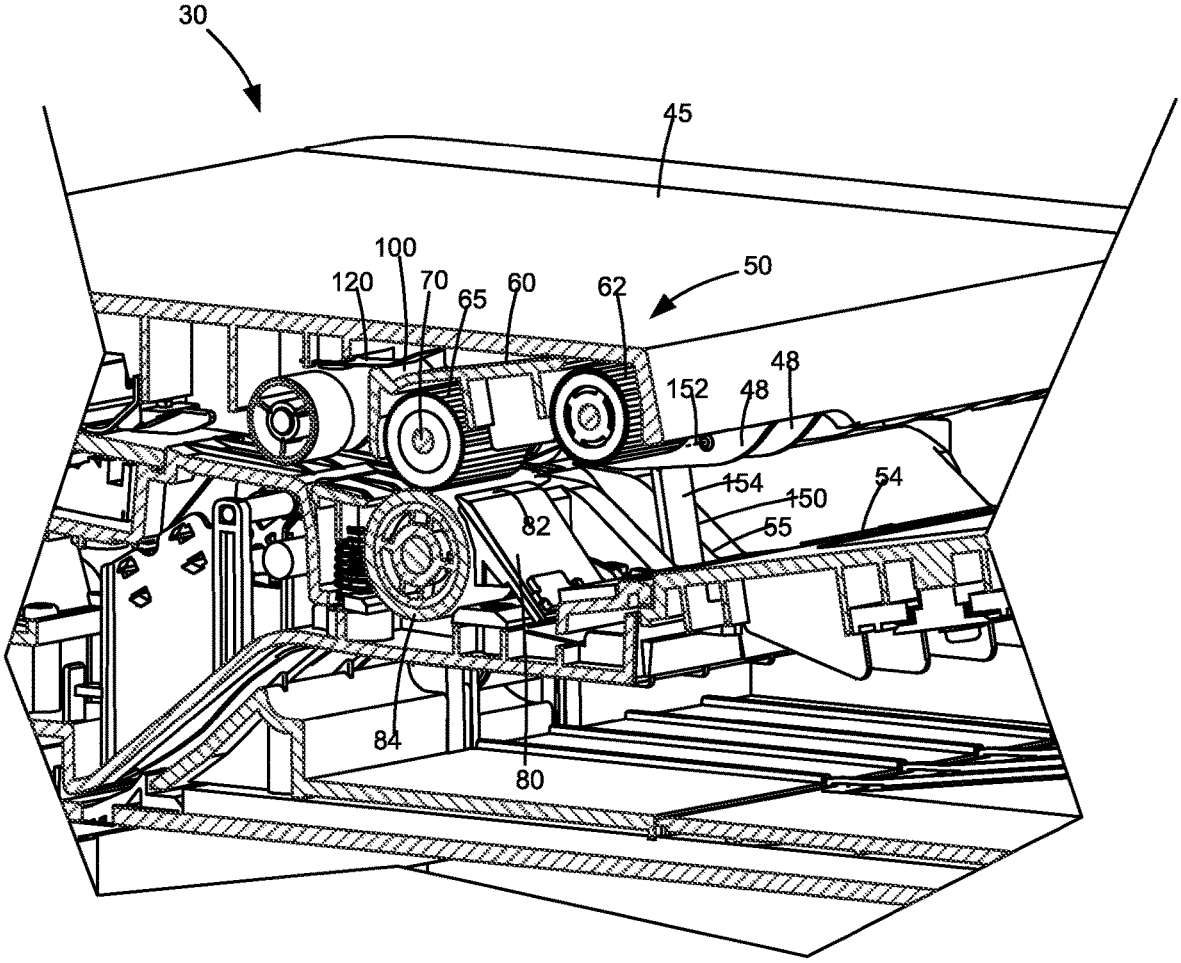
FIGS. 4A and 4B are cross sectional views showing the pick mechanism in a raised position and a lowered position, respectively, according to one example embodiment.
Figure 4B:
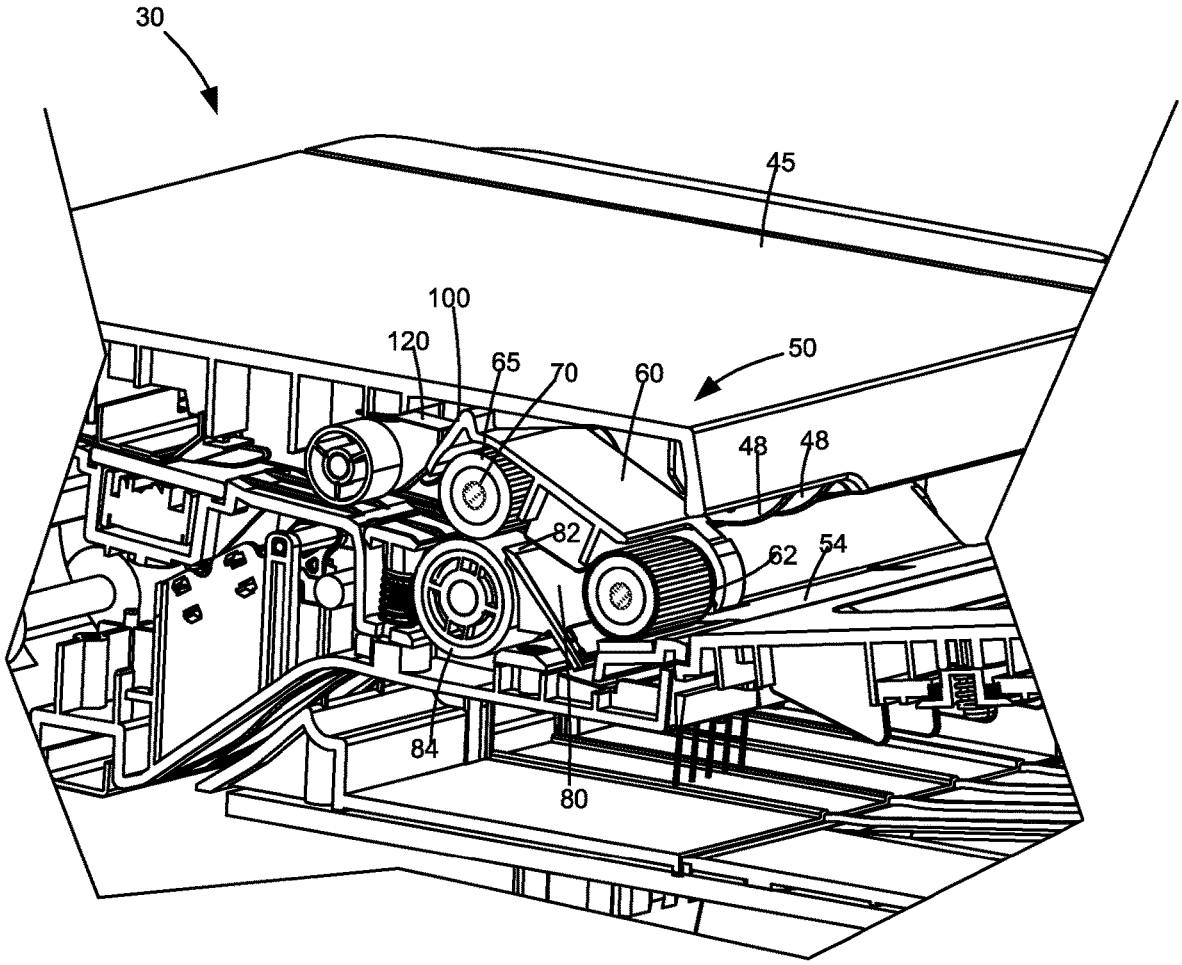

FIGS. 3-4B illustrate pick mechanism 50 for picking media sheets disposed on input tray 54 of ADF 30 according to one example embodiment. FIG. 3 is a perspective view illustrating pick mechanism 50. FIGS. 4A and 4B are cross sectional views with pick mechanism 50 in a raised position and a lowered position, respectively. In the embodiment illustrated, pick mechanism 50 is attached to top cover 45 of ADF 30. Pick mechanism 50 includes a pick arm 60 having a first end 66 mounted to a shaft 70. A pick roller 62 is mounted at a second end 63 of pick arm 60 for contacting a topmost media sheet of a media stack disposed in input tray 54. A feed roller 65 is mounted at first end 66 of pick arm 60 for feeding picked media sheets into ADF media path 32. Pick roller 62 and feed roller 65 are driven by shaft 70 which receives torque from a drive source, such as a drive motor 75 (schematically shown), to provide rotational force to feed roller 65 and pick roller 62. In the embodiment shown, shaft 70 is mechanically coupled to drive motor 75 via a gear 73 attached to shaft 70. Pick roller 62 rotates in a direction 64 to pick and move media sheets into ADF media path 32.

In the embodiment illustrated, pick arm 60 includes a drive train 68 for transmitting from shaft 70 both a rotational force and a downward force to pick roller 62. In this example, pick mechanism 50 utilizes a clutch 77 to allow pick arm 60 and pick roller 62 to rotate toward or away from the media sheet on input tray 54 depending on the direction of the rotational force applied to shaft 70. For example, when drive motor 75 rotates in a first direction, pick arm 60 pivots toward the media sheet and pick roller 62 rotates to pick and feed the media sheet. When drive motor 75 rotates in a second or reverse direction, pick arm 60 is raised and pick roller 62 is lifted from engagement with the media sheet disposed on input tray 54. In one example, clutch 77 includes a rated torque limiter that creates dynamic normal force on pick roller 62 for picking media sheets when drive motor 75 is engaged and rotates in the first direction, and allows pick arm 60 to be raised when drive motor 75 rotates in the reverse direction. Reverse rotation of drive motor 75 may be used to reset ADF 30 after a scan job is completed so that another scan job may be performed using ADF 30.

During use, pick roller 62 drives the topmost media sheet into a ramp 80 which directs the leading edge of the picked media sheet into ADF media path 32. Ramp 80 may include a relatively firm, low friction material, such as Mylar, to provide media separation if more than one media sheet is fed into ramp 80. A rubber separation pad 82 may also be used to add friction to a bottom sheet in order to separate media sheets if more than one media sheet move up ramp 80. Additionally, a separator roller 84 may be positioned against feed roller 65 to hold back a bottom sheet and allow feed roller 65 to feed a top sheet if more than one media sheet reach the nip between feed roller 65 and separator roller 84. In other embodiments, any assembly or mechanism to separate multiple media sheets may be utilized.

The angle at which pick arm 60 extends from shaft 70 and the pick height of pick roller 62 at that angle typically provides a corresponding normal force or pressure applied by pick roller 62 on the topmost media sheet of the media stack in input tray 54 due to the weight of pick mechanism 50 and/or rotational force from drive motor 75. The height of the media stack decreases with each media sheet being picked and pick arm 60 rotates through various angular positions as each media sheet is fed and as the media stack height decreases. The normal force, which is applied substantially perpendicular to the flat surface of the topmost media sheet by pick roller 62, thus varies as the angular position of pick arm 60 changes. Further, depending on the ADF architecture, different external forces may act on the media stack in input tray 54 such that more normal force may be needed in some locations of the media stack than others. For instance, a fully stacked input tray may have more drag from a media guide limiter and/or from contact with upper media guide ribs such that more normal force by the pick roller may be needed at the top than at the bottom of the media stack Conversely, if mechanisms in an ADF assembly result in more drag at the bottom of the media stack, more normal force by the pick roller may be needed at the bottom than at the top of the media stack.

Pick mechanism 50 includes passive mechanical features that allow for pick roller 62 to apply different normal forces for varying media stack heights in input tray 54. In the embodiment illustrated, pick mechanism 50 includes a rib feature 100 projecting from first end 66 of pick arm 60 towards top cover 45 and a spring 120 attached to top cover 45. Rib feature 100 provides an engagement surface for spring 120 to contact as pick arm 60 rotates through various angular positions. Spring 120, in the example shown, comprises a cantilevered leaf spring with one end attached to top cover 45 via a post 121 and a free end that contacts rib feature 100 of pick arm 60. Spring 120 is configured to apply a dynamic biasing force to pick arm 60 that varies depending on the angular position of pick arm 60 in order to create a dynamic normal force applied by pick roller 62 to the topmost media sheet as the height of the media stack changes.

The profiles of spring 120 and rib feature 100 are shaped to allow contact between spring 120 and rib feature 100 at various points along spring 120 and/or rib feature 100 that result in different normal forces applied by pick roller 62 to the top of the media stack. In general, spring 120 and rib feature 100 may be shaped to apply more normal force where it is needed (e.g., media stack location with relatively more media drag) and less to none where it is not needed (e.g., media stack location with relatively less media drag) which depends on the specific ADF architecture as discussed above. For purposes of illustration, the following examples are described with respect to spring 120 and rib feature 100 causing more normal force to be applied by pick roller 62 at the top than at the bottom of the media stack.

The varying normal force application can be in conjunction with a different separation profile of ramp 80, by which the geometry and material can be optimized to achieve better separation. The higher separation force can then be compensated by the spring 120 and rib 100 interaction as the contact point 107 shifts based on the stack height of the media. Therefore, the ramp 80 may not have to be linear or have uniform frictional property.

Figure 5A:
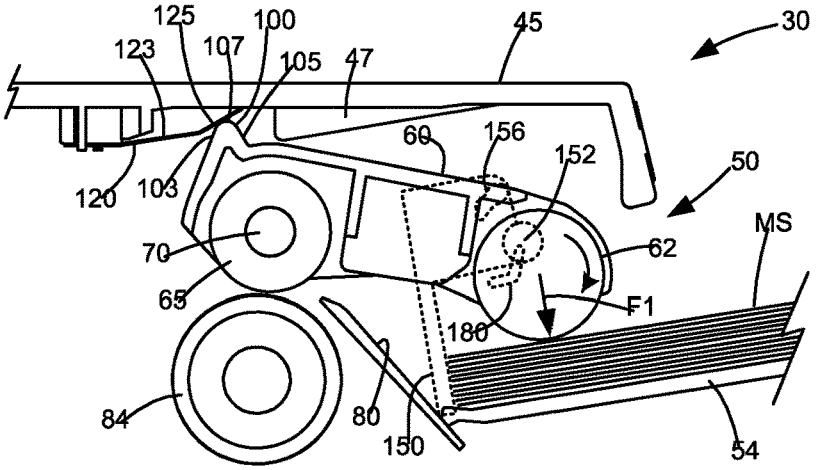
FIGS. 5A-5C illustrate different angular positions of a pick arm of the pick mechanism, according to one example embodiment.
Figure 5B:
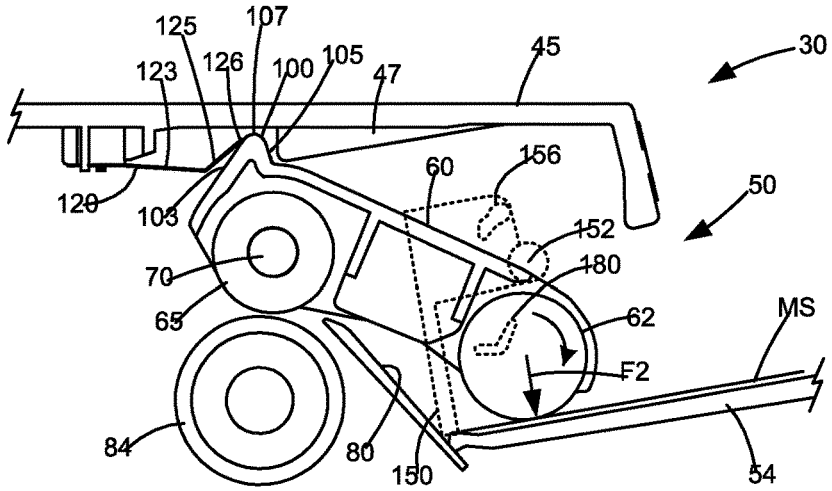
Figure 5C:
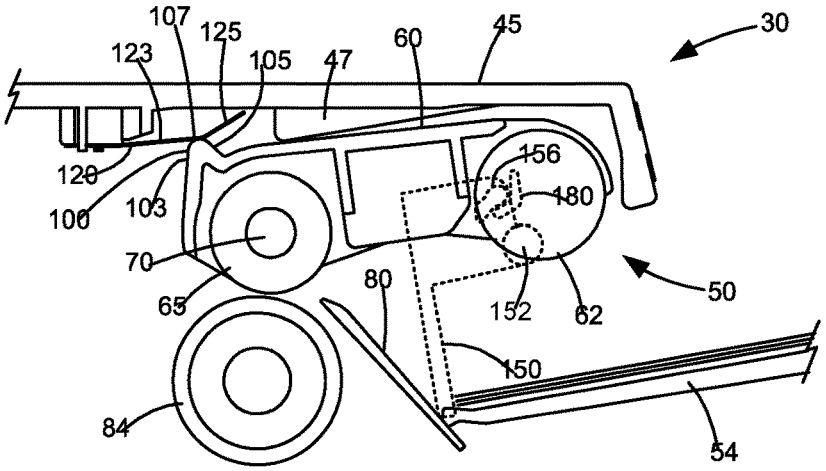

FIGS. 5A-5C illustrate different angular positions of pick arm 60 and corresponding points of contact between spring 120 and rib feature 100. In the embodiment illustrated, spring 120 includes a first segment 123 attached to top cover 45 and a second segment 125 extending at an angle from first segment 123. Rib feature 100 includes a first engagement surface 103 and a second engagement surface 105 having a common apex 107. When media stack MS is full as shown in FIG. 5A, pick arm 60 is at an angular position where an intermediate portion of second segment 125 of spring 120 contacts rib feature 100 at apex 107. In this position, spring 120 is deflected and applies a rotational force on pick arm 60 in a clockwise direction, as viewed in FIG. 5A, that causes pick roller 62 to apply a normal force F1 on the topmost media sheet of media stack MS.

As the height of media stack MS decreases, pick arm 60 rotates downward and pick roller 62 moves closer to the bottom of media stack MS. In FIG. 5B, pick roller 62 is in contact with a last page of media stack MS and pick arm 60 is at an angular position where a distal end 126 of second segment 125 of spring 120 is in contact with first engagement surface 103 of rib feature 100 near apex 107. In this position, spring 120 is less deflected relative to when media stack MS is full (FIG. 5A) such that spring 120 applies less rotational force on pick arm 60 in the clockwise direction, as viewed in FIG. 5B, causing pick roller 62 to apply a normal force F2 on the last page of media stack MS that is less than normal force F1. Accordingly, the profiles of spring 120 and rib feature 100 allow pick roller 62 to apply a dynamic normal force on the topmost media sheet that decreases as media stack height decreases.

In the above example, the point of contact between spring 120 and rib feature 100 changes along spring 120 as well as along rib feature 100 to allow pick roller 62 to apply the dynamic normal force on the media stack. Further, spring 120 exerts a varying rotational force on pick arm 60 that urges pick arm 60 to rotate clockwise in a direction towards the lowered position such that pick roller 62 applies more normal force on the media sheet at the top of the media stack and less normal force on the media sheet at the bottom of the media stack. However, as discussed above, spring 120 and rib feature 100 may be shaped to apply a varying rotational force on pick arm 60 that cause more normal force to be applied by pick roller 62 at the bottom than at the top of the media stack as needed depending on the ADF architecture.

In addition to providing dynamic pick normal force, spring 120 may help provide additional normal force for stacks of original documents that are uneven and highly compressible due to corrugated, wrinkled, or bent sheets in the media stack. For example, corrugated and/or wrinkled sheets may cause the top of the stack to end up above the design intent of ADF 30 which can lead to media jams, or reduce the total normal force applied by pick roller 62 to the topmost sheet. In other cases, media may form trailing edge corrugation and cause pick arm 60 to bounce as media sheets are picked and fed. The additional normal force caused by spring 120 can help to further compress the stack of media and overcome corrugated sheets as well as stabilize pick mechanism 50 in order to minimize bounce allowing for more consistent pick timing and efficiency.

After a scan job using ADF 30 is completed, drive motor 75 drives pick arm 60 to rotate counterclockwise, as viewed in FIG. 5C, towards the raised position to allow loading of a next set of media to be scanned in input tray 54. In the raised position, pick arm 60 is at an angular position where first segment 123 of spring 120 is in contact with rib feature 100 at apex 107 such that spring 120 exerts a downward force at first end 66 of pick arm 60 to provide a holding force that helps hold pick arm 60 in the raised position. In particular, in this position, the downward force imparted by spring 120 causes a rotational force on pick arm 60 that urges pick arm 60 to rotate in a direction towards the raised position Additionally, in the embodiment illustrated, top cover 45 includes a stop rib 47 that is positioned to be engaged by second engagement surface 105 of rib feature 100 to limit rotational movement of pick arm 60 in the clockwise direction, such as when top cover 45 is lifted or opened.

In a further embodiment, in the raised position, pick arm 60 is configured to hold one or more media stops that are used to aid in locating media in input tray 54 to prevent loading of media too far into input tray 54 and/or provide positive user feedback that media is set correctly in a desired loading position in input tray 54. With reference back to FIGS. 3 and 4A, ADF 30 includes a pair of media stops 150 pivotably mounted to ribs 48 (see also FIG. 2B) of top cover 45 about respective pivot axes 152. Each media stop 150 is engaged and held in an upright position by pick arm 60 to act as a media restraint upstream of ADF media path 32 for preventing media from being loaded too far into input tray 54 when pick arm 60 is in the raised position. When pick arm 60 is lowered down from its raised position, each media stop 150 is disengaged from pick arm 60 allowing media stop 150 to freely swing or rotate about pivot axis 152 to thereby allow media in input tray 54 to be fed into ADF media path 32.

In the embodiment illustrated, each media stop 150 includes a swing arm 154 extending from pivot axis 152 toward input tray 54 and through a corresponding opening 55 in input tray 54 for contacting leading edges of media disposed in input tray 54. From a point above pivot axis 152, each media stop 150 includes an extension arm 156 extending towards pick arm 60. Hook features 180 are defined on both sides of pick arm 60. When pick arm 60 is in the raised position, hook features 180 are positioned to engage corresponding extension arms 156 of media stops 150 to limit rotational movement of extension arms 156 in a direction away from ADF media path 32 to thereby limit rotational movement of swing arm 154 in a direction toward ADF media path 32. In particular, when media is placed in input tray 54 while pick arm 60 is in the raised position (see FIG. 5C showing media stop 150 and hook feature 180 in phantom lines), leading edges of the media abut against swing arms 154 and tend to push swing arms 154 to rotate about respective pivot axes 152 in a direction toward ADF media path 32 and, consequently, extension arms 156 to rotate in a direction toward hook features 180. When extension arms 156 contact hook features 180, media stops 150 are prevented by pick arm 60 from further rotating such that media stops 150 including swing arms 154 are held in the upright position to restrain media in the desired loading position. By holding media stops 150, media can be positioned at the desired location allowing for consistent feed and timing as well as to avoid jams and prevent damage to originals to be scanned. When pick arm 60 is lowered from the raised position (see FIGS. 5A and 5B), hook features 180 disengage extension arms 156 of media stops 150 allowing swing arms 154 of media stops 150 to freely swing about respective pivot axes 152 when media push against swing arms 154 during picking and feeding of media into ADF media path 32.

Friction and inertia from drive train 68 may aid in keeping pick arm 60 in the raised position, which in turn keeps media stops 150 engaged in the upright position for restraining media. However, the assembly may be prone to shock and vibrations which may cause pick arm 60 to drop and media stops 150 to disengage and be released. For example, opening and closing the flatbed scanner when scanning from the flatbed, tapping media on ADF 30 in order to align pages before placing the media in input tray 54, or bumping imaging device 10 may cause pick mechanism 50 to drop down due to its weight and release media stops 150 unintendedly before media is loaded in input tray 54.

In an example embodiment, spring 120 is configured to hold pick arm 60 in the raised position even if external forces cause ADF 30 to move, such as when ADF 30 experiences mechanical shock or vibration. In this example, the profiles of spring 120 and rib feature 100 are selected such that the holding force of spring 120 is sufficient to hold pick arm 60 in the raised position even without the inertia from drive train 68 of pick arm 60. If, for example, some motion causes pick arm 60 to drop by a small amount (i.e., not all the way down towards input tray 54 or the media stack), the additional holding force imparted by spring 12 to pick arm 60 may reseat pick arm 60 back in the raised position. When an ADF scan job is initiated, drive motor 75 is rotated in the first direction so as to cause pick arm 60 to pivot downward toward input tray 54 overcoming the holding force from spring 120.

Due to the less aggressive contact point between pick arm 60 and media stops 150 because media stops 150 are not biased into contact with hook features 180 (i.e., no loading force exerted by media stops 150 against pick arm 60), pick arm 60 and pick roller 62 can easily drop down to the media stack to pick and feed media sheets. Further, utilizing the same spring 120 that varies the normal force applied by pick roller 62 during media picking to hold pick arm 60 in the raised position and, consequently, media stop 150 in the upright position during media loading (prior to media picking and feeding) provides a cost effective means that addresses different pick and feed issues. The assembly allows for pick mechanism 50 to be easily removed from ADF 30 and/or replaced because spring 120, which is used to both vary the pick normal forces during media picking and hold media stops 150 in the upright position during media loading, is installed separate from (and does not form part of) pick mechanism 50. In addition to providing a contact surface for spring 120 as discussed above, rib feature 100 may also be used to help users orient pick mechanism 50 for proper installation in ADF 30.

In other alternative embodiments, spring 120 and rib feature 100 may have other designs, profiles, shapes, forms, or structures. Regardless of the design, spring 120 and rib feature 100 function to influence the amount of normal force applied by pick roller 62 to the topmost media sheet of the media stack such that the normal force applied by pick roller 62 varies as media stack height changes, and to help hold pick arm 60 in the raised position during media loading.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

We claim:

1. An assembly for restraining media in an input tray of an imaging device, comprising:

a pick mechanism having a pick arm mounted at a first end thereof on a shaft and a pick roller mounted at a second end of the pick arm, the pick arm is movable between a lowered position in which the pick roller is lowered towards the input tray and a raised position in which the pick roller is lifted away from the input tray;

a media stop member positioned to be engageable by a leading edge of the media when the media is disposed in the input tray, the media stop member is held by the pick arm in a media stop position for restraining the media in a media loading position when the pick arm is in the raised position and is released by the pick arm from being held in the media stop position when the pick arm is in the lowered position; and a spring mounted above the pick mechanism for imparting a downward force at the first end of the pick arm for holding the pick arm in the raised position in order to hold the media stop member in the media stop position, wherein the spring includes a first segment attached to a frame of the imaging device and a second segment extending at an angle from the first segment, the first segment of the spring contacts the pick arm when the pick arm is in the raised position and the second segment of the spring contacts the pick arm when the pick arm is in the lowered position.

2. An assembly for restraining media in an input tray of an imaging device, comprising:

a pick mechanism having a pick arm mounted at a first end thereof on a shaft and a pick roller mounted at a second end of the pick arm, the pick arm is movable between a lowered position in which the pick roller is lowered towards the input tray and a raised position in which the pick roller is lifted away from the input tray;

a media stop member positioned to be engageable by a leading edge of the media when the media is disposed in the input tray, the media stop member is held by the pick arm in a media stop position for restraining the media in a media loading position when the pick arm is in the raised position and is released by the pick arm from being held in the media stop position when the pick arm is in the lowered position; and a spring mounted above the pick mechanism for imparting a downward force at the first end of the pick arm for holding the pick arm in the raised position in order to hold the media stop member in the media stop position, wherein when the pick arm is in the lowered position the spring imparts a first rotational force to the pick arm that urges the pick arm to rotate in a first direction, and when the pick arm is in the raised position the spring imparts a second rotational force that urges the pick arm to rotate in a second direction opposite the first direction.

3. An assembly for restraining media in an input tray of an imaging device, comprising:

a pick mechanism having a pick arm mounted at a first end thereof on a shaft and a pick roller mounted at a second end of the pick arm, the pick arm is movable between a lowered position in which the pick roller is lowered towards the input tray and a raised position in which the pick roller is lifted away from the input tray;

a media stop member positioned to be engageable by a leading edge of the media when the media is disposed in the input tray, the media stop member is held by the pick arm in a media stop position for restraining the media in a media loading position when the pick arm is in the raised position and is released by the pick arm from being held in the media stop position when the pick arm is in the lowered position; and a spring mounted above the pick mechanism for imparting a downward force at the first end of the pick arm for holding the pick arm in the raised position in order to hold the media stop member in the media stop position, wherein the pick arm includes a rib projecting from the first end thereof towards the spring such that the spring engages the rib to impart the downward force to the pick arm.

4. An assembly for restraining media in an input tray of an imaging device, comprising:

a pick mechanism having a pick arm rotatably mounted at a first end thereof on a shaft and a pick roller mounted at a second end of the pick arm, the pick arm is movable between a lowered position in which the pick roller is lowered towards the input tray and a raised position in which the pick roller is lifted away from the input tray;

a media stop member positioned to be engageable by a leading edge of the media when the media is disposed in the input tray, the media stop member is held by the pick arm in a media stop position for restraining the media in a media loading position when the pick arm is in the raised position and is released by the pick arm from being held in the media stop position when the pick arm is in the lowered position; and a spring mounted above the pick mechanism for imparting to the pick arm a first rotational force that urges the pick arm to rotate in a first direction that is towards the lowered position when the pick arm is in the lowered position and a second rotational force that urges the pick arm to rotate in a second direction that is towards the raised position when the pick arm is in the raised position in order to hold the pick arm in the raised position thereby holding the media stop member in the media stop position.

5. The assembly of claim 4, wherein the spring includes a cantilevered spring.

6. The assembly of claim 4, wherein the spring includes a leaf spring.

7. The assembly of claim 4, wherein the spring includes a first segment attached to a frame of the imaging device and a second segment extending at an angle from the first segment, the first segment of the spring contacts the pick arm when the pick arm is in the raised position and the second segment of the spring contacts the pick arm when the pick arm is in the lowered position.

8. The assembly of claim 4, wherein the pick arm includes a rib projecting from the first end thereof towards the spring such that the spring engages the rib to impart the first rotational force and the second rotational force to the pick arm.

9. An assembly for restraining media in an input tray of an imaging device, comprising:

a pick mechanism having a pick arm rotatably mounted at a first end thereof on a shaft and a pick roller mounted at a second end of the pick arm, the pick arm is movable between a lowered position in which the pick roller is lowered towards the input tray and a raised position in which the pick roller is lifted away from the input tray;

a media stop member positioned to be engageable by a leading edge of the media when the media is disposed in the input tray, the media stop member is held by the pick arm in a media stop position for restraining the media in a media loading position when the pick arm is in the raised position and is released by the pick arm from being held in the media stop position when the pick arm is in the lowered position; and a spring mounted above the pick mechanism and in contact with the pick arm when the pick arm moves between the lowered position and the raised position, wherein when the pick arm is disengaged from the raised position the spring imparts a first rotational force that urges the pick arm towards the lowered position, and when the pick arm engages the raised position the spring imparts a second rotational force opposite the first rotational force to hold the pick arm in the raised position thereby holding the media stop member in the media stop position.

10. The assembly of claim 9, wherein the spring includes a cantilevered spring.

11. The assembly of claim 9, wherein the spring includes a leaf spring.

12. The assembly of claim 9, wherein the spring includes a first segment attached to a frame of the imaging device and a second segment extending at an angle from the first segment, the first segment of the spring contacts the pick arm when the pick arm is in the raised position and the second segment of the spring contacts the pick arm when the pick arm is in the lowered position.

13. The assembly of claim 9, wherein the pick arm includes a rib projecting from the first end thereof towards the spring such that the spring engages the rib to impart the downward force to the pick arm.

* * * * *